US005094298A

United States Patent [19]

Polan

[11] Patent Number: 5,094,298

[45] Date of Patent: Mar. 10, 1992

[54] FIRE SPRINKLER APPARATUS

[75] Inventor: George S. Polan, Harleysville, Pa.

[73] Assignee: Central Sprinkler Corporation, Lansdale, Pa.

[21] Appl. No.: 449,612

[22] Filed: Dec. 12, 1989

[51] Int. Cl.[5] ..... A62C 37/08

[52] U.S. Cl. ..... 169/41; 169/19; 169/37; 169/38

[58] Field of Search ..... 169/37, 38, 39, 41, 169/19; 137/70, 72, 79

[56] References Cited

U.S. PATENT DOCUMENTS

| | | | |
|---|---|---|---|
| 3,714,989 | 2/1973 | Gloeckler | 169/19 |
| 3,802,510 | 4/1974 | Johnson | 169/19 |
| 3,848,676 | 11/1974 | Doherty, Jr. | 169/37 |
| 4,015,665 | 4/1977 | Simons et al. | 169/40 |
| 4,465,141 | 8/1984 | Johnson | 169/37 |
| 4,491,182 | 1/1985 | Pieczykolan | 169/38 |
| 4,508,175 | 4/1985 | Pieczykolan | 169/38 |
| 4,618,002 | 10/1986 | Mears | 169/37 |
| 4,766,961 | 8/1988 | Macie | 169/38 |

*Primary Examiner*—Joseph F. Peters, Jr.
*Assistant Examiner*—Linda L. Palomar
*Attorney, Agent, or Firm*—Panitch Schwarze Jacobs & Nadel

[57] ABSTRACT

A fire sprinkler apparatus comprises a tubular body, a valve and a locking mechanism, the tubular body having a longitudinal axis and a conduit extending therethrough and being connectable to a supply of pressurized fire extinguishing fluid. The conduit has an annular groove proximate the outlet end of the tubular body, the valve forming a fluid-tight seal proximate the outlet end in a closed position and being completely separable from the fire sprinkler apparatus. The locking mechanism being supported by the tubular body for limited movement between an engaged position and a disengaged position, the locking mechanism comprising a housing, a plurality of locking balls moveable toward and away from the annular groove, a locking disc and temperature responsive means.

4 Claims, 4 Drawing Sheets

FIG. 1
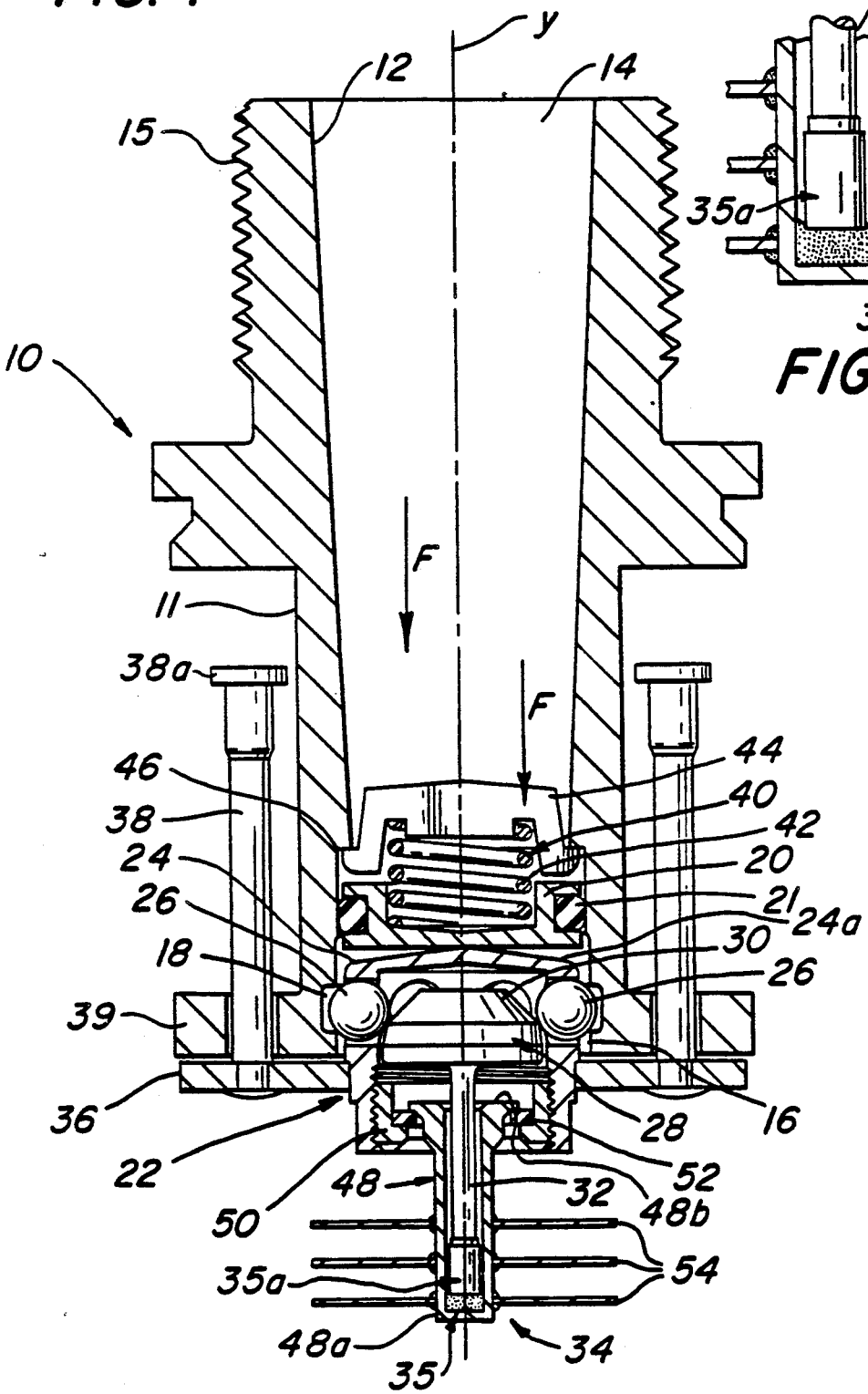
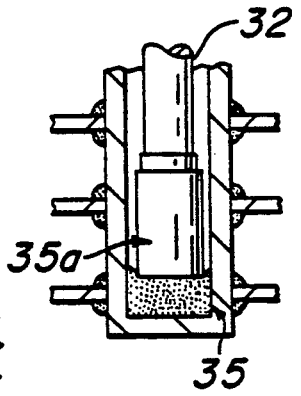
FIG. 1A 12
y
14
15
10
F 32
35
35a

44
F
46
11
18
44
38a
40
39
16
42
38
F
24a
20
F
24
21
26
26
30
36
28
22
50
48
52
48b
36
32
54
34
48a
35

FIRE SPRINKLER APPARATUS

BACKGROUND OF THE INVENTION

1. Field of the Invention

The present invention relates to fire extinguishing sprinklers adapted to respond quickly to the presence of heat exceeding a predetermined temperature, which can be mounted substantially flush with the ceiling of a fire protected enclosure.

2. Description of the Prior Art

Quick response sprinkler systems are a commonly used means for automatically protecting residential, commercial and public buildings from a fire. It has been generally recognized in the fire protection industry that one goal of quick response sprinkler devices is to minimize the unsightly appearance of the sprinkler. Attempts to minimize the unsightliness of sprinkler devices include installing sprinklers in an enclosure which is mounted flush with the ceiling or wall of the fire protected room. However, such enclosures create thermal insulation, whereby the temperature response mechanism of the sprinkler device is somewhat insulated from the fire protected room, thereby reducing thermal response time for sprinkler activation. It is often desirable, therefore, to expose the temperature responsive portion of the sprinkler device to the ambient conditions of the room or building to be protected by the sprinkler device.

Other attempts to minimize the unsightliness of sprinkler devices include reducing the size and portion of the sprinkler device which extends into a fire protected room. For example, in several conventional sprinklers, the temperature responsive portion of the sprinkler is extended into the room or building enclosure only as much as is necessary to place a temperature responsive mechanism into direct or nearly direct air contact with the fire protected room, leaving the remainder of the sprinkler (the body and the valve and locking mechanisms) generally out of sight.

One example of such a device is disclosed by U.S. Pat. No. 4,465,141, which discloses a fire sprinkler having a locking and latching mechanism internally disposed in a sprinkler body and a temperature responsive mechanism extending outwardly from the sprinkler body and into a fire protected room when installed. The sprinkler disclosed by this patent has a slideable valve and deflector arrangement which is held in retracted condition by a complex captive locking mechanism which moves with the valve from the closed to the opened position and both the valve and locking mechanisms are retained by the sprinkler body. However, the combined valve, locking and latching mechanism, being retained by the sprinkler assembly during operation, obstructs the flow of fluid from the sprinkler and results in a decreased fluid distribution pattern from the sprinkler. In addition, this combined mechanism is relatively expensive to manufacture, requiring a high tolerance assembly and relatively large amounts of anti-corrosive materials forming the combined valve, locking and latching mechanism.

Recognizing the difficulties and inefficiencies inherent in the device disclosed by U.S. Pat. No. 4,465,141, U.S. Pat. No. 4,766,961 discloses a fire sprinkler apparatus wherein the valve is separate and distinct from the locking mechanism. However, during actuation of the sprinkler apparatus disclosed in this patent, the locking mechanism, including the thermally responsive mechanism, is ejected from the sprinkler body under the force of the fire extinguishing fluid and ejector springs mounted on the sprinkler body. The valve is retained by the sprinkler body.

Unlike the apparatus disclosed in U.S. Pat. No. 4,465,141, the locking mechanism of the sprinkler disclosed in the latter patent is external to the sprinkler body and relatively large. When actuated, the larger locking mechanism is propelled from the sprinkler (often under forces of 50 to 200 psi), becoming a source of danger for persons or materials in the vicinity of the actuated sprinkler. Moreover, because the locking mechanism is external to the sprinkler body, the locking mechanism and thermally responsive mechanism protrude further into a fire protected room than do the corresponding mechanisms disclosed in, for example, U.S. Pat. No. 4,465,141. Thus, the device disclosed in this patent is unsightly and dangerous.

In the view of the deficiencies and inefficiencies of the prior art, it would be desirable to have a fire sprinkler apparatus which has a good fluid distribution pattern, which is relatively simple and inexpensive to produce, which is visually appealing when installed and which exhibits a safe, quick response to a predetermined elevated temperature.

SUMMARY OF THE INVENTION

According to the present invention, a fire sprinkler apparatus comprises a generally tubular body having a longitudinal axis and a conduit extending therethrough along the longitudinal axis. The conduit defines an inlet end connectable to a supply of pressurized fire extinguishing fluid and an outlet end and the conduit has an annular groove proximate the outlet end. Valve means are provided for forming a fluid-tight seal proximate the outlet end in a closed position and being completely separable from the fire sprinkler apparatus where the valve means receives a primary force produced by at least the pressurized fluid. Locking means are provided for retaining the valve means in the closed position and for releasing the valve means in response to the presence of heat exceeding a predetermined temperature the locking means being supported by the tubular body for limited movement between an engaged position in which the valve means is retained in the closed position and a disengaged position in which the valve means is released.

The locking means comprises a housing, a plurality of locking balls supported in the housing and moveable toward and away from the annular groove in the conduit, a locking disc axially moveable within the housing and having a surface engaging the locking balls, and temperature responsive means retaining the locking disc in an engaged position in which the locking disc engages and holds the locking balls at least partially within the annular groove to retain the housing in contact with the valve means to hold the valve means in a closed position. The temperature responsive means is responsive to the presence of heat exceeding the predetermined temperature to release the locking disc and locking balls to release the valve means from the closed position.

The fire sprinkler apparatus also preferably further comprises deflector means supported by the tubular body for limited movement with the locking means for deflecting fire extinguishing fluid discharged from the outlet end of the conduit.

BRIEF DESCRIPTION OF THE DRAWINGS

The foregoing summary of the invention, as well as the following detailed description of preferred embodiments, will be better understood when read in conjunction with the appended drawings. For the purpose of illustrating the invention, there is shown in the drawings embodiments which are presently preferred, it being understood, however, that the invention is not limited to the specific arrangements and instrumentalities disclosed. In the drawings:

FIG. 1 is a partial cross-sectional view of the fire sprinkler apparatus according to the present invention showing the sprinkler in the engaged or closed position;

FIG. 1*a* is an enlarged cross-sectional view of a lower portion of FIG. 1;

DETAILED DESCRIPTION OF PREFERRED EMBODIMENTS

Figures 2, 2A, 2B:
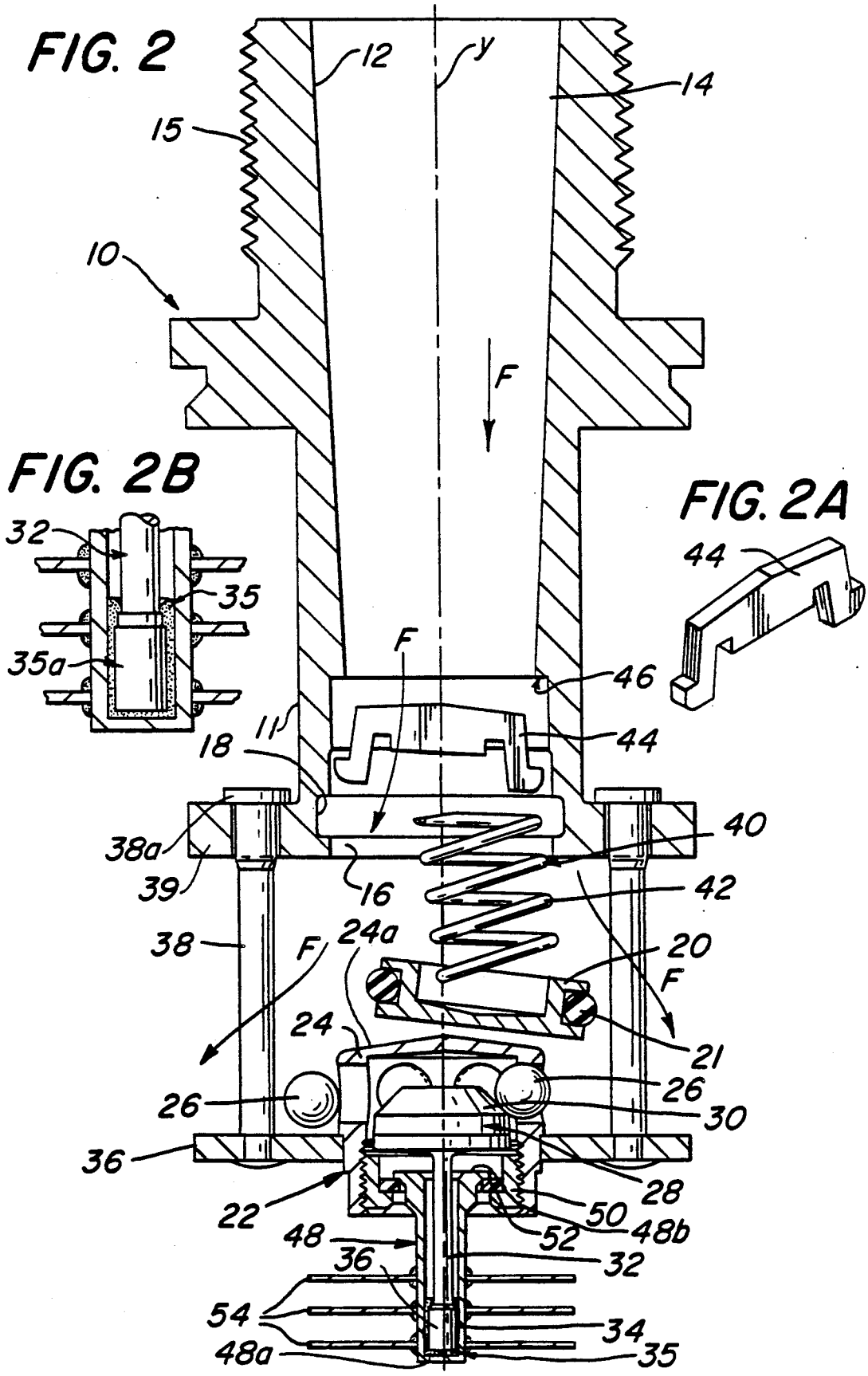
FIG. 2 is a partial cross-sectional view of the fire sprinkler apparatus illustrated in FIG. 1 showing the sprinkler in the disengaged or open position.
FIG. 2*a* is a generalized isometric view showing the retaining member illustrated in FIG. 2.
FIG. 2*b* is an enlarged cross-sectional view of a lower portion of FIG. 2.

Referring to the drawings, wherein like numerals indicate like elements throughout the several views, they are shown in FIGS. 1 through 4 a fire sprinkler apparatus 10 according to the present invention. The fire sprinkler apparatus 10 comprises a generally tubular body 11 having a longitudinal axis y and a conduit 12 extending through the tubular body 11 along the longitudinal axis y. The conduit 12 defines an inlet end 14 and an outlet end 16. The inlet end 14 is connectable in a manner well-known in the art to a supply or source of pressurized fire extinguishing fluid (not shown), such as by thread means 15 illustrated in the drawings.

The tubular body 11 is preferably fabricated of a generally non-corrosive material, such as a bronze alloy, although one skilled in the art will recognize that the tubular body 11 may alternatively be formed of some other generally non-corrosive materials depending on the particular fire extinguishing fluid to be used and/or the local building code. In any event, the tubular body 11 should comprise a suitable material having structural and/or operational characteristics which are satisfactory in view of standards established by the American National Standards Institute ("ANSI") and Underwriters Laboratory ("UL") for fire sprinkler systems. The tubular body 11 may be manufactured using apparatus and techniques wellknown in the art.

According to the present invention, the conduit 12 has a generally annular groove 18 proximate the outlet end 16, which may be machined, molded or otherwise formed into the inner side wall of the conduit 12. The annular groove 18 is preferably generally rectangular in cross-section and is wide enough and deep enough to at least partially receive at least a portion of locking balls (discussed below) but should not be so deep or wide as to substantially diminish or otherwise interfere with the structural integrity of the tubular body 11 or the flow of the pressurized fluid through the conduit 12 when the sprinkler apparatus is actuated in a manner which will hereinafter become apparent.

Figure 3:
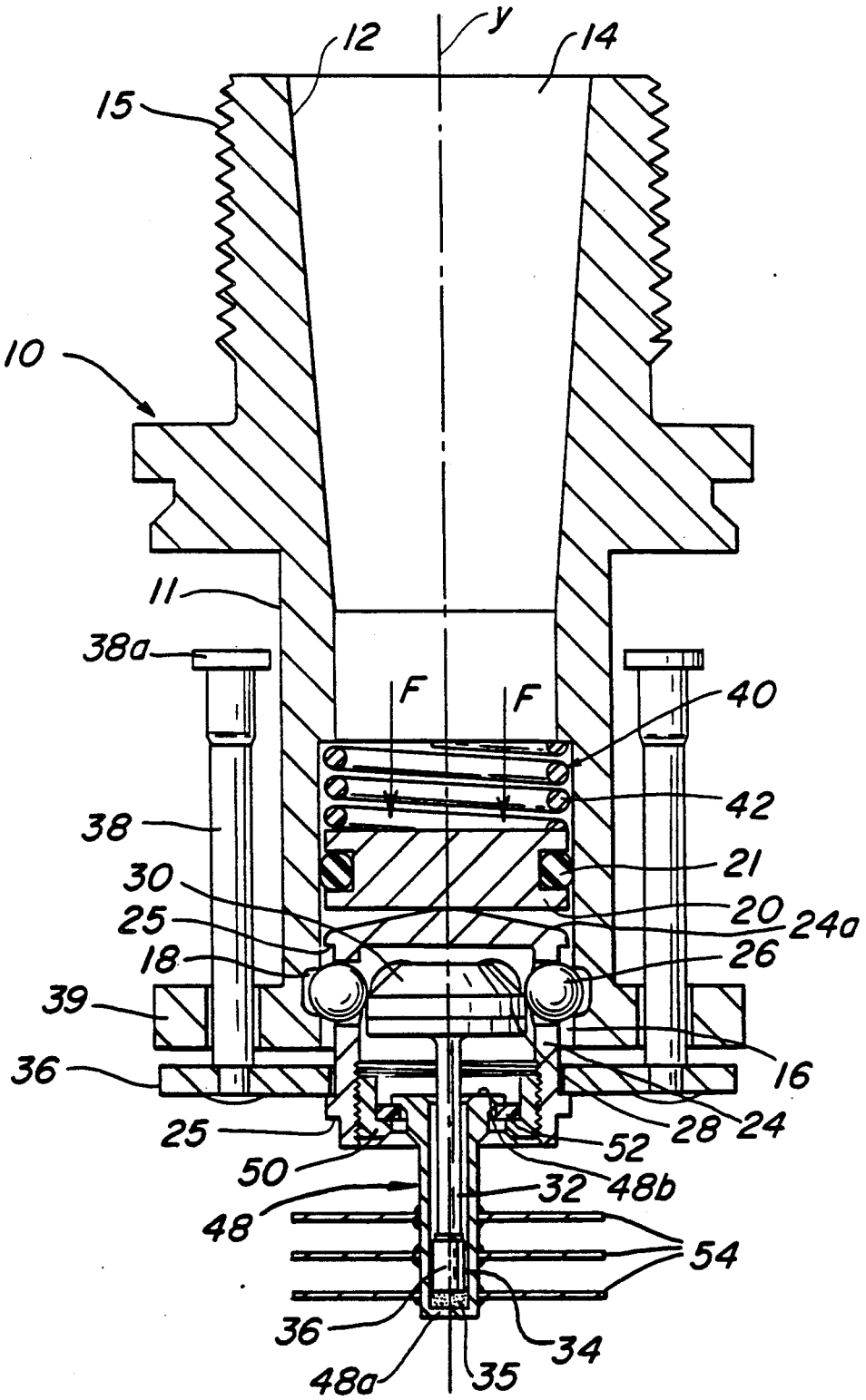
FIG. 3 is a partial cross-sectional view of another embodiment of a fire sprinkler apparatus according to the present invention showing the sprinkler in the engaged or closed position.

In accordance with the present invention, the fire sprinkler 10 further comprises valve means 20 for forming a fluid-tight seal with the outlet end 16 of the conduit 12 when in an engaged or closed position, as illustrated in FIGS. 1 and 3. The valve means 20 is structurally independent from the remainder of the fire sprinkler apparatus and is preferably fabricated of a generally inflexible, non-corrosive material, such as a bronze alloy. Preferably, the valve means 20 also comprises a conventional O-ring 21, which may be positioned in an annular groove or recess on the valve means 20 as illustrated in FIGS. 1 through 4. One skilled in the art will appreciate that the O-ring 21 or other sealing means (such as V-rings, T-rings or other ring assemblies) should comprise materials which will resist corrosion or oxidation over time and one may determine what material and type of ring to use based on several factors present in the particular fire sprinkler system, such as fluid pressure, fluid type and compatibility with the materials comprising the tubular body 11 and valve means 20.

It will be recognized by one skilled in the art that when the sprinkler 10 is connected to a source of fire extinguishing fluid, the valve means 20 receives a primary force produced by the pressurized fluid. It may also be desired to apply an additional force on the valve means 20 to urge the valve means 20 away from the closed position, particularly where it is desired to guard against low fire extinguishing fluid pressure and/or valve sticking due to an oxidized O-ring, for example. It is preferred in accordance with the present invention that biasing means 40 be positioned in engagement with the valve means 20 to apply a force to urge the valve means 20 away from the closed position.

Preferably, the biasing means 40 comprises a first end engaging the valve means 20 and a second end engaging an annular shoulder 46 on the conduit 12 proximate the outlet end 16. The annular shoulder 46 is positioned in the conduit 12 so that the annular groove 18 is between the outlet end 16 and the annular shoulder 46 as illustrated in FIGS. 1 through 4. Like the annular groove 18, the annular shoulder 46 may be machined, molded or otherwise formed into the side wall of the conduit 12 using techniques and apparatus known in the art.

It is presently preferred that the biasing means 40 comprises a coil spring 42, although one skilled in the art will appreciate that other biasing means, such as annular springs or spring clips, may alternatively be used in accordance with the present invention. The biasing means 40 should comprise a material which is generally non-corrosive and which is compatible with the materials comprising the valve means 20 and the tubular body 11, preferably a non-corrosive metal, such as stainless steel. Where a coil spring 42 is used in the sprinkler apparatus 10 in the present invention, the coil spring 42 preferably has a first end engaging the valve means 20 and a second end engaging the annular shoulder 46 (FIGS. 3 and 4) or a retaining member 44 (FIGS. 1 and 2) which, in turn, engages the annular shoulder 46.

The retaining member 44 is preferably formed of a material which is compatible with the materials comprising the tubular body 11 and the coil spring 42, such as stainless steel. The retaining member 44 is preferably formed of a generally flat clip-like member, as illustrated in FIG. 2*a*, to minimize obstruction of fluid flow and minimize damage or injury which may be caused by the retaining member being expelled during actuation of the fire sprinkler apparatus. One skilled in the art will appreciate, however, that other retaining members may be used in accordance with the present invention, as long as the retaining member 44 does not obstruct the flow of fire extinguishing fluid.

In accordance with the present invention, the fire sprinkler apparatus further comprises locking means 22 for retaining the valve means 20 in the closed position and for releasing the valve means 20 in response to the presence of heat exceeding a predetermined temperature. The locking means 22 is supported by the tubular body 11 for limited movement between a closed or engaged position (illustrated in FIGS. 1 and 3) in which the valve means 20 is retained in the closed position, and an open or disengaged position (illustrated in FIGS. 2 and 4) in which the valve means 20 is released to permit the flow of fire extinguishing fluid through the conduit 12. The locking means 22 comprises a generally cylindrical housing 24, a plurality of locking balls 26, a locking disc 28 having a generally frustoconical shaped surface and a temperature responsive means 34.

The locking means housing 24 contains the locking balls 26, the locking disc 28 and the temperature responsive means 34 and should also be fabricated of a generally non-corrosive material, such as a bronze alloy. In the engaged position, the locking means housing 24 is supported by the tubular body 11 by the locking balls 26 and the annular groove 18 in the conduit 12 in a manner described below as illustrated in FIGS. 1 and 3. In the disengaged position, the locking means housing 24 is supported by the tubular body 11 for limited movement with a generally annular, plate-like member or deflector 36 having a central hole through which the locking means housing 24 is secured. The deflector 36 has generally rod-shaped guide arms 38 extending through a preferably generally annular flange 39 extending outwardly from the tubular body 11 proximate the outlet end 16 to guide the deflector 36 and the locking means housing 24 secured therethrough for limited movement between the closed and open positions.

Figure 4:
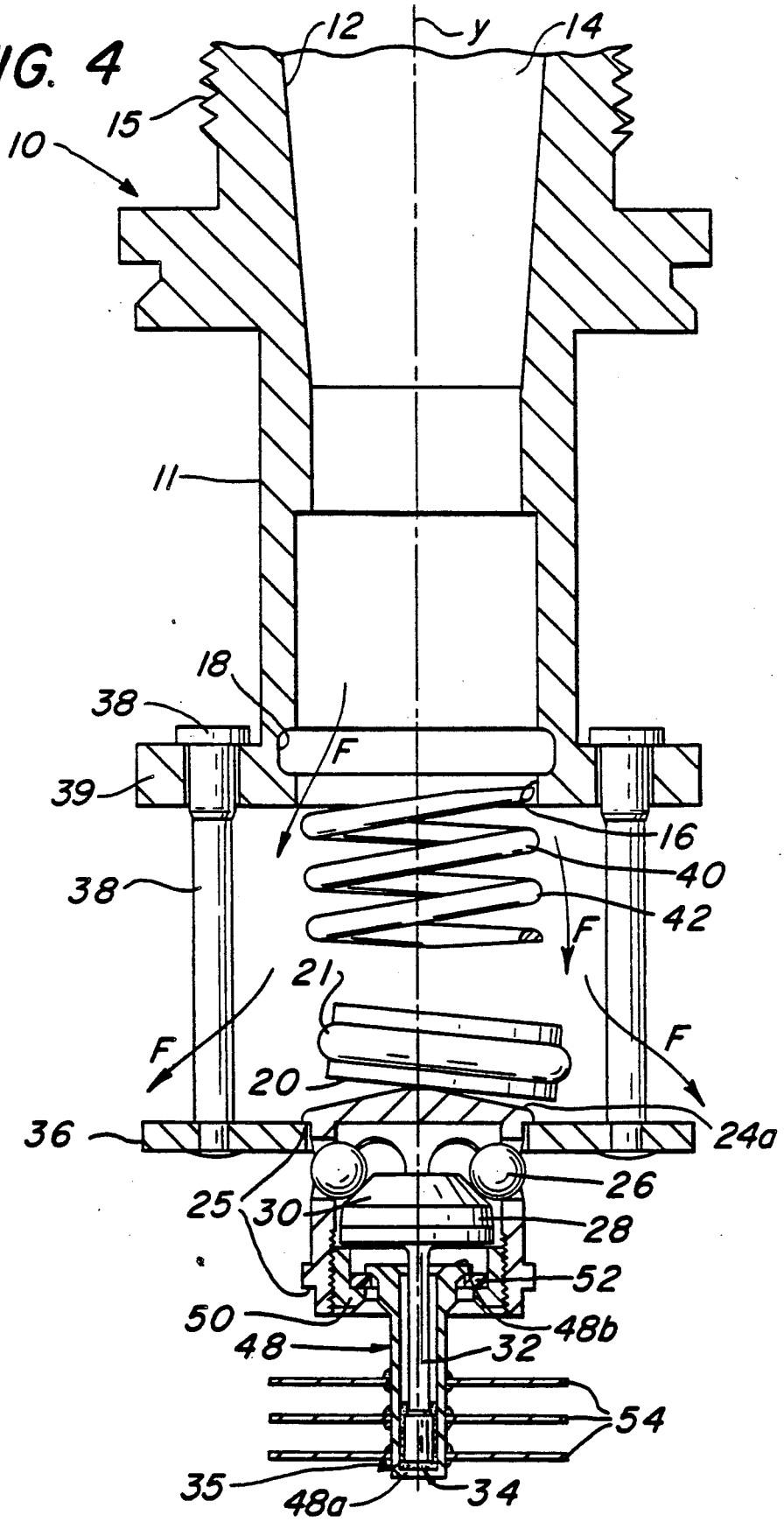
FIG. 4 is a partial cross-sectional view of the fire sprinkler apparatus illustrated in FIG. 3 showing the sprinkler in the disengaged or open position.

The guide arms 38 further have stops 38*a*, which are preferably flange-like members positioned on the ends of the guide arms 38 distal the deflector 36 which engage the annular flange 39 in the open position. The guide arm stops 38*a* prevent the deflector 36 and the locking means housing 24 from separating from the tubular body 11 and support the deflector 36 and housing 24 in the open position as illustrated in FIGS. 2 and 4.

Where deflector means 36 is used in accordance with the present invention, the locking means 22 is secured to and moveable with the deflector means 36 by, for example, a press fit or by welding. The locking means 22 may also be secured to the deflector 36 by forming on the surface of the locking means housing 24 engaging shoulders 25, which may be annular, extending outwardly from the surface of the locking means housing 24 to a diameter greater than the inner diameter of the hole through the deflector means 36, allowing limited lateral movement relative to the deflector means 36, as illustrated in FIGS. 3 and 4.

Preferably also where deflector means 36 is used in accordance with the present invention, the locking means 22 is disposed between the outlet end 16 of the conduit 12 and the deflector means 36. In this manner, the locking means housing 24 may also act as a deflector for fire extinguishing fluid discharged from the fire sprinkler apparatus. Accordingly, it may be desired to form the upper surface 24*a* (proximate the valve means 20 in the closed position) of the locking means housing 24 in the shape of a cone or convex arc to facilitate deflection of the fire extinguishing fluid.

The upper surface 24*a* of the locking means housing 24 engages the valve means 20 in the engaged or closed position to hold the valve means 20 in the closed position. Where the surface 24*a* of the locking means housing 24 engaging the valve means 20 has a cone or convex shape, the valve means 20 engages the locking means 22 in point contact, facilitating efficient separation of the valve means 20 from the remainder of the sprinkler apparatus during actuation.

According to the present invention, the locking balls 26 ar supported in the locking means housing 24 and are moveable toward and away from the annular groove 18 in the conduit 12. The locking balls 26 should comprise a material which is generally non-corrosive and which is compatible with the materials comprising the locking means housing 24 and the tubular body 11. It is presently preferred that the locking balls 26 comprise stainless steel ball bearings but other suitable materials could alternatively be employed.

As disclosed in U.S. Pat. No. 4,465,141, such moveable locking balls and annular groove establish, reliably and inexpensively, the desired locking function and facilitate accurate distribution of the applied primary force (exerted from the pressurized fire extinguishing fluid and/or the biasing means 40) so that the primary force is not entirely transmitted to the locking disc 28 and temperature responsive means 34. One skilled in the art will appreciate that the ball and groove locking mechanism facilitates a quick response (release) time and allows the use of generally quicker acting temperature responsive means.

The locking disc 28 is positioned within the locking means housing 24 and is generally axially centered (i.e., along the longitudinal axis y of the tubular body 11) within the housing 24. The locking disc 26 preferably comprises a generally circular disc extending perpendicular to the longitudinal axis y and has a generally tapered or frustoconical engaging surface 30 for engaging the locking balls 26. When force is applied to the locking disc 28 by contact with the temperature responsive means (discussed below), locking balls 26 are urged radially outwardly into the annular groove 18. The engaging surface 30 of the locking disc 28 engages and holds the locking balls 26 at least partially within the annular groove 18 to retain a surface of the housing means 22 in contact with the valve means 20 to hold the valve means 20 in the closed position. The engaging surface 30 of the locking disc 28 holds the locking balls 26 at least partially in the annular groove 18 as long as the temperature responsive means 34 remains substantially intact (i.e., pre-thermal response), engaging the locking disc 28 with a particular force.

The temperature responsive means 34 is responsive to the presence of heat exceeding a predetermined temperature. The desired temperature may be readily determined by one skilled in the art, based upon the temperature at which it is desired to have the fire sprinkler apparatus to expel fire extinguishing fluid. Generally, the predetermined temperature is preferably about 160° F., although one skilled in the art will appreciate that higher and lower temperatures may be used in particular applications in accordance with the present invention.

It is presently preferred that the temperature responsive means 34 include a eutectic material 35, such as those materials generally availabe from Indium Corp. of America, although one skilled in the art will appreciate that other temperature responsive means and materials, such as frangible glass enclosures, may alternatively be used in the temperature responsive means 34 in accordance with the present invention.

Where a eutectic material 35 is used in the temperature responsive means 34, a bearing member 35*a*, preferably formed of a ceramic, is preferably included for more uniformly distributing compressive load from the locking disc 28 to the eutectic material 35. In addition, a ceramic bearing member 35*a* acts as an insulator for the eutectic material 35, whereby heat transmitted to the eutectic material 35 is not siphoned off by the locking disc 28, thus avoiding possible impairment of the reactivity of the eutectic material 35.

In the presently preferred embodiment of the present invention, the temperature responsive mean 34 includes a generally tubular member 48 having a first or external end 48*a* extending outwardly from the outlet end 16 of the conduit 12, generally along the axis y of the tubular body 11 and a second or opposite end 48*b*. The tubular member 48 is secured to the locking means housing 24 and preferably contains therein a plug of fusible or eutectic material 35 and a bearing disc 36 at the external end 48*a* of the tubular member 48.

The tubular member 48 is preferably adjustably retained by the locking means housing 24 to permit adjustment of the particular force with which the temperature responsive means 34 engages the locking disc 28. It is preferred that the locking means housing 24 is internally threaded and that the tubular member 48 further comprises a complimentary threaded portion 50 engageable with the internally threaded housing 24 so that at least a portion of the tubular member 48 (i.e., that portion proximate the second end 48*b*) is retained in the locking means housing 24. It will be understood in view of this disclosure that the fire sprinkler apparatus 10 may be engaged (closed) or disengaged (opened) by unscrewing the complementary threaded portion 50 from the housing 24 to release the force on the locking disc 28 and the locking balls 28, allowing the balls to move away from the annular groove 18. The ability to engage and disengage the locking means 22 facilitates assembly and servicing of the sprinkler apparatus 10 at the factory.

In the pre-responsive state, the plug of frangible or eutectic material 35 in the external end of the tubular member 48 engages bearing member 35*a* which then engages pushrod 32 extending generally downwardly from the locking disc 28. The pushrod 32 maintains the locking disc 28 in an engaged position in which the engaging surface 30 of the locking disc 28 holds the locking balls 26 at least partially within the annular groove 18 to retain the housing in contact with the valve means 20 to thereby retain the valve means 20 in the closed position as illustrated in FIGS. 1 and 3.

In operation as illustrated in FIGS. 2 and 4, in the post responsive state (i.e., after the predetermined temperature has been reached), the frangible or eutectic material 35, having melted, fractured, etc., allows the bearing member 35*a* and the pushrod 32 to move downwardly so that the locking disc 28 also moves downwardly along the axis y, allowing the locking balls 26 to move radially inwardly and away from the annular groove 18. The inward movement of the locking balls 26 releases the locking means 22 to move into the open or disengaged position, thereby releasing the valve means 20, which moves downwardly and out of the conduit 12 under the urging of coil spring 42 and the pressurized fluid. When released, the locking means 22, secured to the deflector 36 drops or moves away from the outlet end 16 of the conduit 12, guided by the guide arms 36 until the guide arm stops 38*a* engage the annular flange 39, preventing further movement of the deflector 36 and locking means 22. The fluid is thus free to flow in directions F to extinguish flames in the proximity of the sprinkler apparatus 10.

It will be appreciated by one skilled in the art that when the valve means 20 is released from the sprinkler apparatus 10 (typically along with the biasing means 40) in accordance with the present invention, the outlet end 16 is relatively free from obstruction. This allows relatively free fluid flow from the outlet end 16 to the deflector 36 for desired fire extinguishing fluid distribution.

Further in accordance with the present invention, it may be desired to increase the thermal conductivity of the tubular member 48 to facilitate the response of the temperature responsive means 34 to temperatures outside the tubular member 48. It is presently preferred that the tubular member 48 further comprise thermal fins 54 attached to the external tubular member surface proximate the external end of the tubular member 48 for more efficiently conducting ambient temperature to the tubular member 48 and therefore to the plug of frangible or eutectic material 35.

One skilled in the art will recognize in view of this disclosure that, particularly where the tubular body 11, valve means 20 and locking means 22 comprise metals, such as brass and/or copper, these components of the fire sprinkler apparatus will readily conduct the typically cooler temperatures of the pressurized fluid to the temperature responsive means 34. To attenuate this type of thermal conductivity, it is presently preferred to position an insulating ring 52 between the tubular member 48 and the complementary threaded portion 50, although one skilled in the art will recognize that such configuration is not necessary to the present invention.

It will be appreciated by those skilled in the art that changes could be made to the embodiments described above without departing from the broad inventive concept thereof. Accordingly, reference should be made to the appended claims, rather than to the foregoing specification, as indicating the scope of the invention.

I claim:

1. A fire sprinkler apparatus comprising:

(a) a generally tubular body having a longitudinal axis and a conduit extending therethrough along the longitudinal axis, the conduit defining an inlet end connectable to a supply of pressurized fire extinguishing fluid and an outlet end, the conduit having an annular groove proximate the outlet end;

(b) valve means for forming a fluid-tight seal proximate the outlet end in a closed position and being completely separable from the fire sprinkler apparatus, the valve means receiving a primary force produced by at least the pressurized fluid;

(c) biasing means engaging the valve means to urge the valve means away from the closed position, the biasing means comprising a coiled spring having a first end engaging the valve means and a second end engaging a retaining member, the retaining member engaging an annular shoulder on the conduit proximate the outlet end, the annular groove being positioned between the annular shoulder and the outlet end; and (d) locking means for retaining the valve means in the closed position and for releasing the valve means in response to the presence of heat exceeding a predetermined temperature, the locking means being supported by the tubular body for limited movement between an engaged position in which the valve means is retained in the closed position and a disengaged position in which the valve means is released, the locking means comprising a housing a plurality of locking balls supported in the housing and movable toward and away from the annular groove in the conduit, a locking disc axially movable within the housing and having a surface engaging the locking balls, and temperature responsive means retaining the locking disc in an engaged position in which the locking disc engages and holds the locking balls at least partially within the annular groove to retain the housing in contact with the valve means to hold the valve means in the closed position, said temperature responsive means being responsive to the presence of heat exceeding said predetermined temperature to release the locking disc and the locking balls to release the valve means from the closed position.

2. A fire sprinkler apparatus comprising:

(a) a generally tubular body having a longitudinal axis and a conduit extending therethrough along the longitudinal axis, the conduit defining an inlet end connectable to a supply of pressurized fire extinguishing fluid and an outlet end, the conduit having an annular groove proximate the outlet end;

(b) valve means for forming a fluid-tight seal proximate the outlet end in a closed position and being completely separable from the fire sprinkler apparatus, the valve means receiving a primary force produced by at least the pressurized fluid;

(c) locking means for retaining the valve means in the closed position and for releasing the valve means in response to the presence of heat exceeding a predetermined temperature, the locking means being supported by the tubular body for limited movement between an engaged position in which the valve means is retained in the closed position and a disengaged position in which the valve means is released, the locking means comprising a housing, a plurality of locking balls supported in the housing and movable toward and away from the annular groove in the conduit, a locking disc axially movable within the housing and having a surface engaging the locking balls, and temperature responsive means retaining the locking disc in an engaged position in which the locking disk engages and holds the locking balls at least partially within the annular groove to retain the housing in contact with the valve means to hold the valve means in the closed position, said temperature responsive means being responsive to the presence of heat exceeding said predetermined temperature to release the locking disc and the locking balls to release the valve means from the closed position; and (d) biasing means to urge the valve means away from the closed position, said biasing means comprising a first end engaging the valve means and a second end engaging an annular shoulder on the conduit proximate the outlet end, the annular groove being positioned between the shoulder and the outlet end.

3. A fire sprinkler apparatus comprising:

(a) a generally tubular body having a longitudinal axis and a conduit extending therethrough along the longitudinal axis, the conduit defining an inlet end connectable to a supply of pressurized fire extinguishing fluid and an outlet end, the conduit having an annular groove proximate the outlet end;

(b) valve means for forming a fluid-tight seal proximate the outlet end in a closed position and being completely separable from the fire sprinkler apparatus, the valve means receiving a primary force produced by at least the pressurized fluid; and (c) locking means for retaining the valve means in the closed position and for releasing the valve means in response to the presence of heat exceeding a predetermined temperature, the locking means being supported by the tubular body for limited movement between an engaged position in which the valve means is retained in the closed position and a disengaged position in which the valve means is released, the locking means comprising a housing, a plurality of locking balls supported in the housing and movable toward and away from the annular groove in the conduit, a locking disc axially movable within the housing and having a surface engaging the locking balls, and temperature responsive means retaining the locking disc in an engaged position in which the locking disc engages and holds the locking balls at least partially within the annular groove to retain the housing in contact with the valve means to hold the valve means in the closed position, said temperature responsive means being responsive to the presence of heat exceeding said predetermined temperature to release the locking disc and the locking balls to release the valve means from the closed position, and said temperature responsive means including a generally tubular member having an external end extending outwardly from the outlet end of the conduit, the tubular member being retained by the locking means housing and containing a plug of fusible material having a melting point generally coinciding with the predetermined temperature at its external end, the plug having a first end proximate the external end of the tubular member and an opposite second end, the tubular member further containing a bearing member engaging the second end of the plug, the locking disc including a bushrod engaging the bearing member.

4. The fire sprinkler apparatus according to claim 3, wherein the bearing member is formed of a ceramic material.

* * * * *